US005163767A

United States Patent [19]

Lucas

[11] Patent Number: 5,163,767

[45] Date of Patent: Nov. 17, 1992

[54] APPLICATOR FOR LIQUID PRODUCTS WITH CAP AND SCREW ADVANCEMENT

[76] Inventor: Marthe Lucas, 22 allée des Fauvettes, 34280 La Grande Motte, Hérault, France

[21] Appl. No.: 635,723

[22] Filed: Dec. 28, 1990

[30] Foreign Application Priority Data

Dec. 28, 1989 [FR] France ..... 89 17307

[51] Int. Cl.[5] ..... A45D 34/00

[52] U.S. Cl. ..... 401/202; 401/116; 401/199

[58] Field of Search ..... 401/202, 199, 196, 116

[56] References Cited

U.S. PATENT DOCUMENTS

| | | | |
|---|---|---|---|
| 2,392,840 | 1/1946 | DeGroft | 401/202 X |
| 2,594,729 | 4/1952 | Carualho | 401/202 |
| 2,629,123 | 2/1953 | Mahruki | 401/116 |
| 2,778,337 | 1/1957 | Lovejoy | 401/116 |
| 3,192,552 | 7/1965 | King | 401/116 |
| 3,446,563 | 5/1969 | Burnham | 401/202 X |
| 4,469,464 | 9/1984 | Capezzuto | 401/202 X |

FOREIGN PATENT DOCUMENTS

| | | | |
|---|---|---|---|
| 654067 | 12/1937 | Fed. Rep. of Germany | 401/116 |
| 841277 | 6/1952 | Fed. Rep. of Germany | 401/116 |
| 2151741 | 5/1973 | Fed. Rep. of Germany | 401/202 |
| 526513 | 5/1955 | Italy | 401/202 |
| 151438 | 10/1979 | Japan | 401/116 |

*Primary Examiner*—Steven A. Bratlie
*Attorney, Agent, or Firm*—Robert W. Becker & Associates

[57] ABSTRACT

The applicator comprises a casing or flask having one end defining a bottom and an other end for mounting a permeable plug. A cap is provided for covering the permeable plug and defines a sealing skirt bearing against a wall of the casing. The casing or flask is placed inside an envelope with respect to which the casing or flask can move axially. The permeable plug has a collar which comes to bear against a shoulder of the casing or flask.

8 Claims, 2 Drawing Sheets

APPLICATOR FOR LIQUID PRODUCTS WITH CAP AND SCREW ADVANCEMENT

FIELD AND BACKGROUND OF THE INVENTION

The present invention relates to applicators for liquid products, such as perfumes, pharmaceutical treatment products and the like.

In particular in the perfumery field, perfume applicators are known, these applicators being made of flasks provided with a plug which has to be removed to put on the skin some liquid product by pouring a small quantity thereof in the hand.

It is also known to use applicators having a plug provided with a sprayer.

Such applicators are in particular used in a so-called hand-bag application.

OBJECT AND SUMMARY OF THE INVENTION

The invention has more particularly for object to provide handbag applicators, and is directed to remedying disadvantages they have, notably due to a risk of leakage which is a permanent fault of this type of applicators.

The invention is directed to a so-called handbag applicator which is of low cost as compared to the liquid product it contains, so that it can be discarded after being used.

According to the invention, the applicator for liquid products comprises a casing or flask having one end defining a bottom and an other end for mounting a permeable plug opposite the bottom, a cap for covering the permeable plug having a sealing skirt, the casing or flask being placed inside an envelope with respect to which the casing or flask is displaceable axially when the cap covering the permeable plug is removed from said envelope, the permeable plug further having a collar resting against a shoulder of the casing or flask, and said sealing skirt contacting directly the permeable plug and bearing against a wall of the casing or flask.

Preferably, the socket or flask forms a chamber which does not contain any free liquid, but is totally filled with a cellulose wadding constantly impregnated with a liquid product.

This impregnated wadding feeds permanently by capillarity a porous applicator plug, placed at the upper portion of the socket or flask.

The upward and downward movement of the casing within the envelope is obtained via a lower knob or knurled wheel.

This advancement system arrests the porous applicator plug in a position of use.

The feeding of liquid product to the permeable plug is permanent whatever the inclination degree of the applicator assembly.

This applicator is therefore usable in a vertical position, and there is no danger of leakage inside a handbag, for example due to the sealing skirt of the cap.

Various other features of the invention will become more apparent from the following detailed description.

BRIEF DESCRIPTION OF THE DRAWINGS

Embodiments of the invention are shown by way of non limiting examples in the accompanying drawings, wherein.

DISCLOSURE OF PREFERRED EMBODIMENTS

Figure 1:
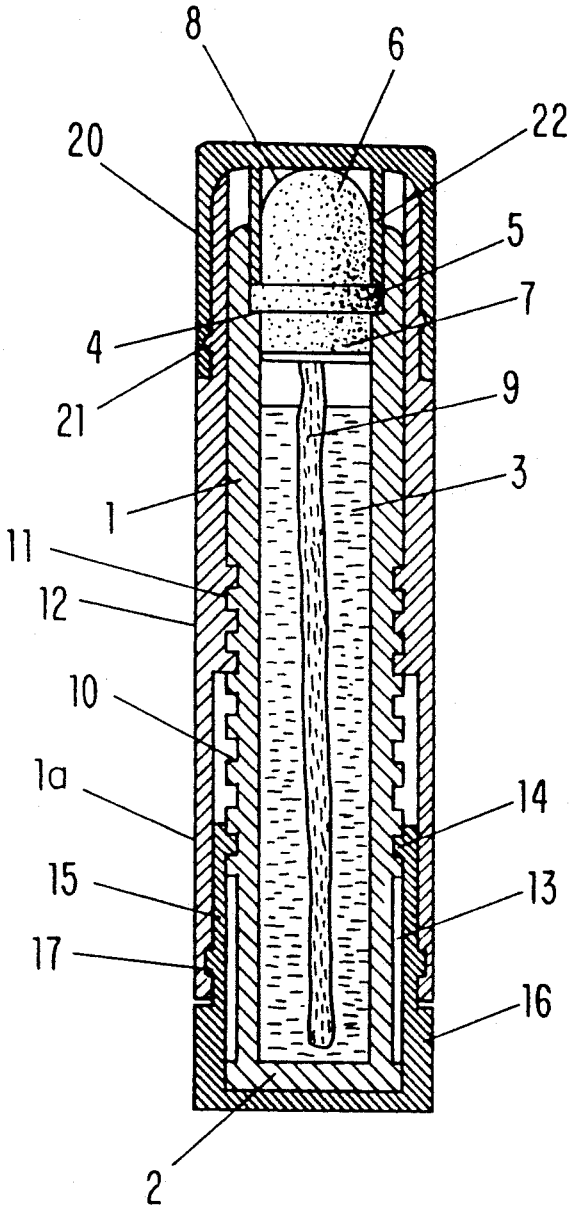
FIG. 1 is a cross sectional view of the applicator of the invention.

The applicator shown in the drawings comprises a casing 1 forming a flask, the bottom 2 of which is closed so as to define a chamber 3 intended for containing a liquid product, such as a perfume, a pharmaceutical treatment product and the like.

The casing or flask 1 is advantageously made of glass, although it may be made of other materials, for example porcelain, or possibly a synthetic material of a type which is not permeable to the product contained therein.

The casing or flask 1 defines an inner shoulder 4 against which abuts a collar 5 of a permeable plug 6.

It is advantageous that the permeable plug 6 comprises a shank 7 extending into the casing or flask 1. On the other hand and as shown in the drawings, the permeable plug 6 is protruding beyond the end of the casing or flask 1 while defining an application portion 8, which is for example dome-shaped.

In the embodiment shown in FIG. 1, the permeable plug 6 is connected to a feeding member, for example a wick or a capillary tube 9, so as to bring permanently the product contained in the chamber 3 toward the permeable plug 6 whatever the level of the product inside the chamber 3.

The outer wall of the casing or flask 1 forms a thread 10 extending only on a portion of its height and screwed in an inner thread 11 formed on an envelope 12.

The casing or flask 1 is also formed, in its outer wall, with at least one groove 13 for cooperating with at least one key 14 formed at a sheath 15 prolonging a knob or knurled wheel 16 extending from the bottom 2 to the base 1*a* of the envelope 12. The sleeve portion 15 defines, in a known manner, a retainer ring 17 engaged inside a groove of the base 1*a* of the envelope 12.

From the foregoing description, it is clear that when one holds the envelope 12 and turns the knob or knurled wheel 16, this action drives in rotation the casing or flask 1 since these two members 16 and 1 cannot rotate with respect to one another due to the slidable engagement of the key 14 inside the groove 13.

Figure 2:
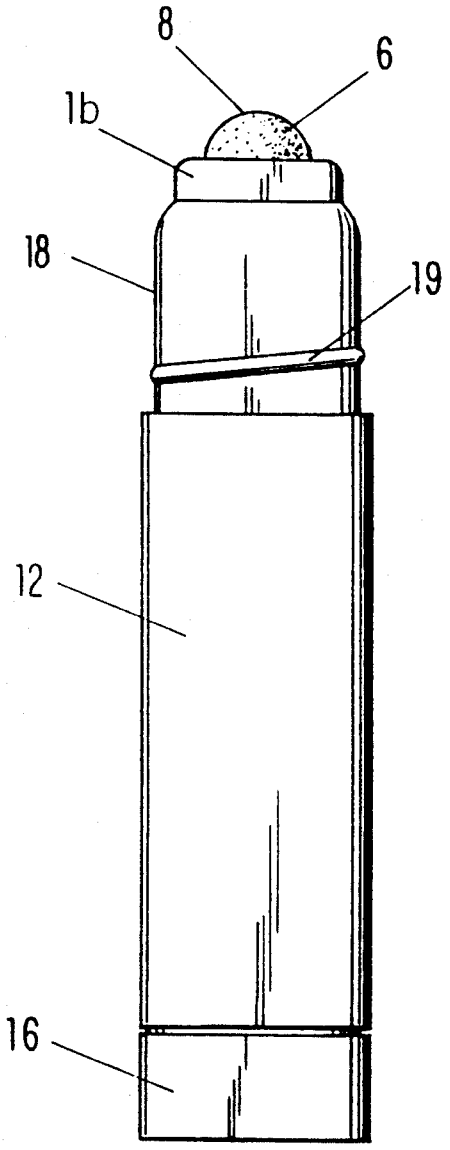
FIG. 2 is a side elevation view showing the applicator, as seen from the outside and not provided with a protective cap.

The effect of the rotary movement which is thus transmitted to the casing or flask 1 is to screw it into the inner thread 11, and consequently the casing or flask 1 is displaced axially inside the envelope 12 until it protrudes from the envelope 12 as shown at 1*b*, in FIG. 2 thereby allowing the application of the perfume or other product by placing the permeable plug 6 on the skin.

An upper portion of the envelope 12 comprises a recessed portion 18 intended for centering a cap 20 including a recess or inner thread 21 corresponding to a protrusion or outer thread 19 of the recessed portion 18 of the envelope 12, for example a helical rib.

The cap 20 is provided inside with a sealing skirt 22 which is inserted between the permeable plug 6 and the wall of the casing or flask 1 when the casing or flask 1 is in position. As can be seen in FIG. 1, the sealing skirt contacts directly the sides of the plug thereby preventing the product from flowing out whatever the position of the applicator when not used, the sealing skirt 22 directly contacting the permeable plug.

Figure 3:
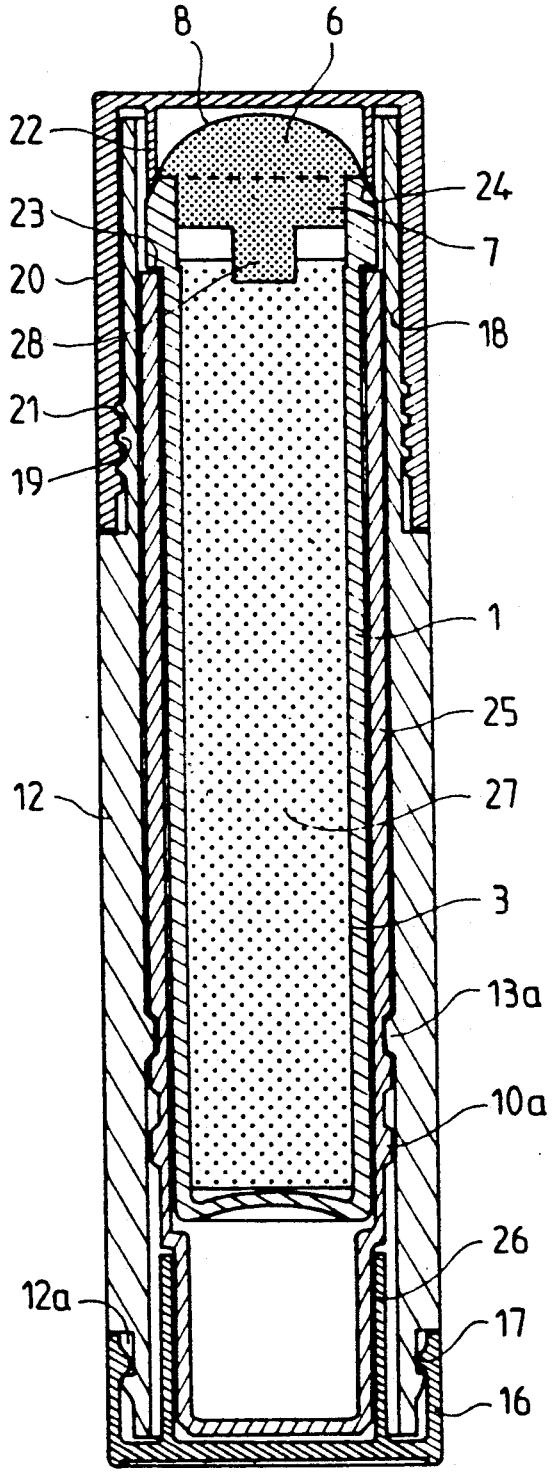
FIG. 3 is a cross sectional view similar to FIG. 1 of an alternative embodiment.

According to the alternative embodiment of FIG. 3, the casing or flask 1, which is made preferably of glass or similar material, has a smooth cylindrical wall with the exception of an outer shoulder 23 at its upper portion as well as a chamfered edge 24 at its upper end.

The casing or flask 1 is supported by its shoulder 23 on the upper edge of a sleeve 25, a portion of which is connected via its base to a sheath 26 formed by the knurled wheel 16. The connection between the sleeve 25 and the sheath 26 of the knurled wheel 16 is provided in such manner that these two members cannot rotate with respect to one another, but can only slide.

As for the example of FIG. 1, a retainer ring 17 of the knob or knurled wheel 16 is engaged inside a groove 12*a* of the envelope 12 so as to permit a rotation of the knob or knurled wheel 16.

The sleeve 25 comprises a thread 10*a* in mesh with at least one thread or groove 13*a* forming an inner thread inside the envelope 12.

In the above described embodiment of FIG. 3, the casing or flask 1 is filled with a material 27 for retaining a liquid, for example an open cell material or a fibrous material, such as a cellulose wadding, the density of which can vary from the bottom to the upper portion of the casing or flask 1 in order to contain as much liquid as possible. It results therefrom that the liquid cannot flow spontaneously except by capillarity toward the permeable plug 6 and the liquid is displaced toward the permeable plug 6 as the drying of the fibers which are most remote from the permeable plug 6 proceeds. Fibers of this nature are for example known mineral fibers of variable density.

The retaining material 27 can extend only on a portion of the height of the casing or flask 1, but in any case the retaining material 27 must prohibit a flowing of the liquid in any way other than by capillarity.

FIG. 3 shows that the porous plug 6 is supported by the upper edge of the casing or flask 1 which forms a shoulder while leaving the chamfered portion 24 free, and that the porous plug 6 is in contact with the retaining material 7 via a shank 28 for limiting the impregnation of the porous plug 6.

The cap 20 is provided inside with a skirt 22 with a slanting edge so as to rest resiliently on the chamfered edge 24, thereby providing a good tightness when the cap 20 is screwed onto the envelope 12.

When the porous plug 6 is moved outwardly by rotating the knob or knurled wheel 16, the cap 20 cannot be put back in place by accident since its screwing onto the envelope 12 would not be possible.

The invention is not limited to the embodiments shown and described in detail since various modifications can be embodied without departing from the scope of the invention as defined by the following claims. In particular, the shape of the outer wall of the envelope 12, as well as that of the knob 16 and cap 20, can be of any type.

I claim:

1. An applicator for liquid products comprising:

a casing or flask, with a first end thereof defining a bottom and a second end thereof, opposite said bottom, for receiving a permeable plug that has a collar resting against a shoulder provided at an inner wall of said casing in an area of said second end, said casing having an outer threaded portion and an axially extending outer groove;

an envelope enclosing said casing in a longitudinal direction thereof, with said casing being axially displaceable inside said envelope when a cap, covering said second end with said permeable plug and engaging said envelope, is removed from said envelope, said envelope having an inner threaded portion engaging said outer threaded portion of said casing;

said cap being provided with a sealing skirt having an inner and an outer wall surface, with said inner wall surface of said sealing skirt contacting directly said permeable plug and with said outer wall surface of said sealing skirt resting against said inner wall of said casing when covering said second end, thereby sealing said plug against leakage; and a knob having a sleeve portion extending toward said second end between said envelope and said casing, said sleeve portion having an end that is facing away from said bottom, said end having a key connected thereto, and having, in the vicinity of said bottom, a retainer ring for connecting said knob to said envelope, with said key engaging said axially extending outer groove provided at said casing to provide a rotationally fixed but axially slidable connection between said knob and said casing for rotating said casing inside said envelope.

2. An applicator according to claim 1, in which said permeable plug comprises an application portion which protrudes from said casing and is enclosed by said sealing skirt of said cap when said cap engages said envelope.

3. An applicator according to claim 1, in which said permeable plug communicates with a feeding member that extends inside said casing.

4. An applicator according to claim 3, in which said feeding member is in the form of a wick.

5. An applicator according to claim 3, in which said feeding member is in the form of a capillary tube.

6. An applicator according to claim 3, in which said feeding member is made of a retaining porous material of variable capillarity, said material filling at least a portion of a chamber defined by said casing and being connected to said permeable plug for prohibiting any flow except by capillarity.

7. An applicator according to claim 1, in which said envelope is provided with a recessed portion equipped with a thread for receiving said cap.

8. An applicator according to claim 1, in which at least said casing is made of a material that is impermeable to said liquid products, such as glass, porcelain, synthetic materials.

* * * * *